US009694228B2

(12) United States Patent
Thulin

(10) Patent No.: US 9,694,228 B2
(45) Date of Patent: Jul. 4, 2017

(54) TRAINING MACHINE FOR STRENGTH TRAINING AND REHABILITATION

(71) Applicant: Mats Thulin, Lidingö (SE)

(72) Inventor: Mats Thulin, Lidingö (SE)

( * ) Notice: Subject to any disclaimer, the term of this patent is extended or adjusted under 35 U.S.C. 154(b) by 0 days.

(21) Appl. No.: 14/215,568

(22) Filed: Mar. 17, 2014

(65) Prior Publication Data

US 2014/0274590 A1 Sep. 18, 2014

(30) Foreign Application Priority Data

Mar. 18, 2013 (SE) ..... 1350326

(51) Int. Cl.
*A63B 21/06* (2006.01)
*A63B 21/00* (2006.01)
(Continued)

(52) U.S. Cl.
CPC .. *A63B 21/00072* (2013.01); *A63B 21/00181* (2013.01); *A63B 21/0615* (2013.01);
(Continued)

(58) Field of Classification Search
CPC ..... A63B 21/00072; A63B 21/00181; A63B 21/00123; A63B 21/0615; A63B 21/1469; A63B 21/151; A63B 21/159; A63B 21/08; A63B 21/1492; A63B 21/154; A63B 23/1263; A63B 23/12; A63B 2021/0617; A63B 2021/0616; A63B 2021/0612
See application file for complete search history.

(56) References Cited

U.S. PATENT DOCUMENTS 4,609,189 A 9/1986 Brasher
4,765,611 A 8/1988 MacMillan
(Continued)

FOREIGN PATENT DOCUMENTS

EP 0617986 A1 10/1994
EP 2269699 1/2011
(Continued)

OTHER PUBLICATIONS

Extended European Search Report mailed Sep. 14, 2014 in European Patent Application No. 14160484.3. pp. 1-6.

*Primary Examiner* — Loan H Thanh
*Assistant Examiner* — Megan Anderson
(74) *Attorney, Agent, or Firm* — Jeffrey S. Melcher; Manelli Selter PLLC

(57) ABSTRACT

A training machine for strength training and rehabilitation having handles which are arranged to lift or lower a weight body via connection means and driving means provided to be moved in a continuous cycle by means of a first or positive, by the user intended exerted force towards said handles, to lift said predetermined weight body and by means of a second or negative, by the user intended exerted force towards said handles, to lower said predetermined weight body, wherein said first force is smaller than said second force. The training machine includes a tiltable arm which via, wheels and belts is connected to the handles and in that said weight body provided at or in the arm is arranged to be moved along the arm to predetermined positions depending on the load which shall be exerted on the handles.

12 Claims, 5 Drawing Sheets

(51) Int. Cl.

| | |
|---|---|
| ***A63B 21/08*** | (2006.01) |
| ***A63B 23/12*** | (2006.01) |
| ***A63B 21/062*** | (2006.01) |
| ***A63B 23/035*** | (2006.01) |

(52) U.S. Cl.

CPC ..... *A63B 21/0616* (2015.10); *A63B 21/0617* (2015.10); *A63B 21/0622* (2015.10); *A63B 21/08* (2013.01); *A63B 21/151* (2013.01); *A63B 21/154* (2013.01); *A63B 21/159* (2013.01); *A63B 21/4035* (2015.10); *A63B 21/4047* (2015.10); *A63B 23/03533* (2013.01); *A63B 23/12* (2013.01); *A63B 23/1209* (2013.01); *A63B 23/1263* (2013.01)

(56) References Cited

U.S. PATENT DOCUMENTS

| | | | | |
|---|---|---|---|---|
| 4,863,161 | A | 9/1989 | Telle | |
| 5,785,632 | A * | 7/1998 | Greenberg | A63B 21/0628 482/1 |
| 7,121,964 | B1 * | 10/2006 | Dahm | A63B 69/0026 473/446 |
| 7,278,958 | B2 * | 10/2007 | Morgan | A63B 21/00072 482/121 |
| 7,785,238 | B2 * | 8/2010 | Thulin | 482/100 |
| 7,976,441 | B2 * | 7/2011 | Ellis | A63B 21/0615 482/114 |
| 8,328,697 | B2 * | 12/2012 | Farbshteyn | 482/100 |
| 8,708,871 | B2 * | 4/2014 | Thulin | 482/100 |
| 8,992,385 | B2 * | 3/2015 | Lemos | A63B 21/06 482/1 |
| 2011/0105284 | A1 * | 5/2011 | Thulin | A63B 21/00181 482/98 |
| 2012/0004081 | A1 | 1/2012 | Ellis | |

FOREIGN PATENT DOCUMENTS

| | | |
|---|---|---|
| FR | 2767707 | 3/1999 |
| GB | 2227676 | 1/1990 |
| WO | 2007/037755 | 4/2007 |

* cited by examiner

TRAINING MACHINE FOR STRENGTH TRAINING AND REHABILITATION

The present invention relates to a training machine for strength training and rehabilitation of the kind described in the preamble of claim 1.

Previously known training machines of the kind mentioned above include most known training machines where the user loads the muscles intended in its body by performing predetermined movements so that weights in a weight body stack are lifted or lowered. At efficient training with both single-joint movements, such as by a biceps curl machine or a leg kick machine, and with multiple-joint movements, such as by a rowing machine, a bench press machine or a leg press machine, it is important that the user of the machine can perform a number of positive and negative working cycles intended for the personal capacity. The positive work implies that weights are being lifted and the negative work implies that weights are being lowered.

In U.S. Pat. No. 4,609,189, a training machine is described which consists of a weight body stack which is articulated at the bottom by means of pivots arranged on each side of the weight body stack. Hence, the entire weight body stack may be moved between a vertical position and a predetermined inclined position by means of a motor being able to turn one of the pivots. In the inclined position, the positive movement is performed as it will be "lighter" for the user to lift the weights in the weight body stack. When the user has moved the weights to an end position, the weight body stack is moved to its vertical position, wherein it will be "heavier" for the user in the negative movement to return the weights to the original position. Then, the same cycle is repeated a number of times. In the construction described in U.S. Pat. No. 4,609,189, the motor has to be very powerful to be able to lift the weight body stack from the inclined position and up to the vertical position. In addition, a considerable force is required to keep the stack in the inclined position after the movement from the vertical position. Such a construction has to be oversized to a very large extent to last during the life of the machine.

In U.S. Pat. No. 4,765,611 a training machine is described which is turnable between different positions to effect different forces in the positive and negative movements. This machine is very complicated with regard to its construction and also to its function.

A training machine is known through WO 2007/037755, at which pivots for a turnable weight stack are arranged at the centre of the weight body stack, wherein a motor at the lower end of the stack is arranged to push the stack between a vertical position and a predetermined inclined position.

GB-A-2227676 describes a device for increasing the weight at a machine to enable that the machine can be loaded additionally, without the need of exchanging weights, so it can be used by both beginners and well-trained persons. This exchange takes place by means of an additional device with a lever system and a gas spring and may be performed between the exercises. Thus, one person will not be able to change the mass of weight body considerably during use.

To change the load with the machine described in the preamble together with a device according to GB-A-2227676 described above, the user must take a break and change the mass of weight by means of the additional device. However, this implies that an optimal training cannot be achieved without it being possible to reduce the total weight of the machine.

The object of the present invention is to provide a training machine of the kind mentioned in the preamble, at which the drawbacks with known machines mentioned above can be overcome and which is simple with regard to construction as well as to function.

The object is achieved with a training machine which has the features according to the characterizing portion of claim 1.

Preferred embodiments of the training machine according to the invention have the characteristics set forth in the sub-claims.

By varying the load so that the positive cycle will be lighter to perform, i.e. a smaller force is required to lift the load executed by torque than to lower it during the same movement cycle, the training person can be able to lift for the negative movement a bigger load than is possible with a normal machine. Possibly, a training session can alternatively be performed in such a manner that a person can perform lifts more times than previously with the same load.

The problems with conventional training machines where one lowers and lifts the same number of weights is that such a known training machine does not consider the advantages by a machine wherein the negative, lowering force being larger than the positive, lifting force. Consequently, the efficiency of such a known training machine is limited. At the training with conventional training machines the number of weights has to be chosen in accordance with the weaker, lifting force. The same number of weights is then lowered at the negative portion of the movement. This number of weights is not on a level with the negative force.

With the training machine according to the invention, the negative force can be practised with a more optimal weight body. The result will be that the fatigue rate of the muscle trained increases. With this invention, it is possible to stimulate a capacity improvement with a less training amount than at training with conventional training machines. Scientific studies have proved that training where the load/weight body is adapted to the negative force gives a quicker and larger strength growth than training where the load/weight body is adapted to the positive force.

By constructing a machine wherein the weight stack is substituted by an arm with a movable weight body mounted thereon, the machine can be constructed in a simpler way, i.e. containing less parts. The weight body is preferably journalled in bearings, as wheels, on a rod within the arm.

The invention will below be described more in detail with reference to the accompanying drawings, which show a preferred embodiment.

Figure 1:
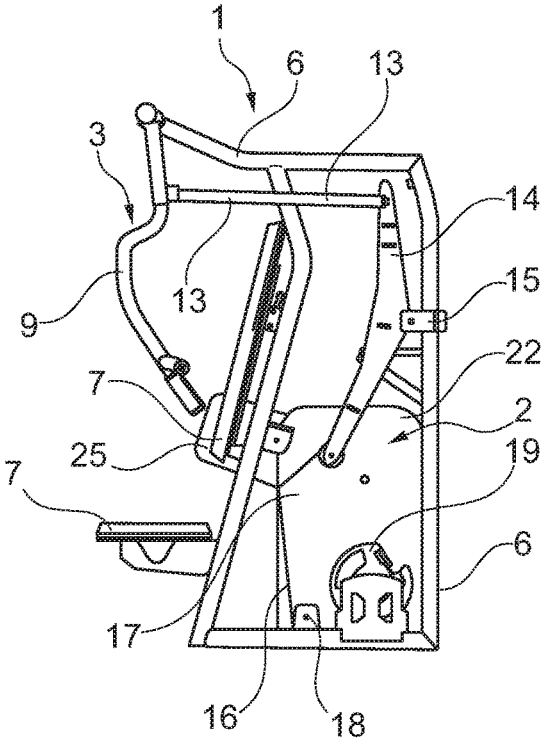
FIG. 1 shows a side view of a training machine for strength training and rehabilitation according to the invention in a rest position.
Figure 7:
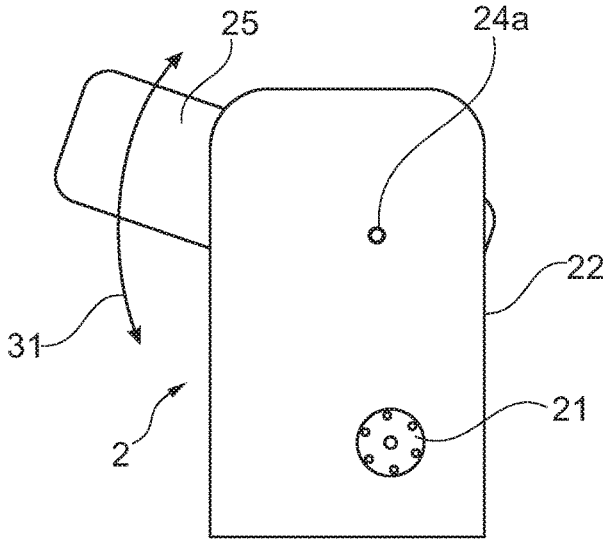

FIG. 7 a side view of the weight section from the opposite side as FIG. 1.

Figure 6:
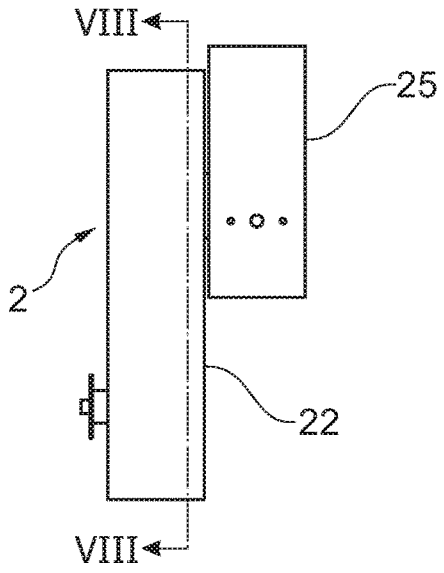
FIG. 6 shows a side view of the weight section of the training machine of FIG. 5.
Figure 8:
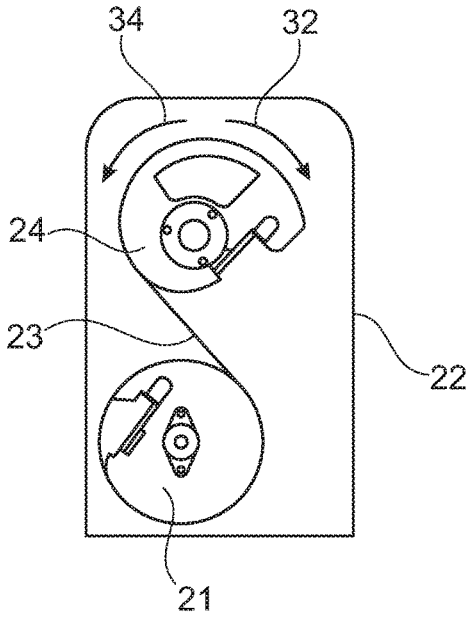

FIG. 8 shows a cross-section along the line VIII-VIII of the FIG. 6.

Figure 9:
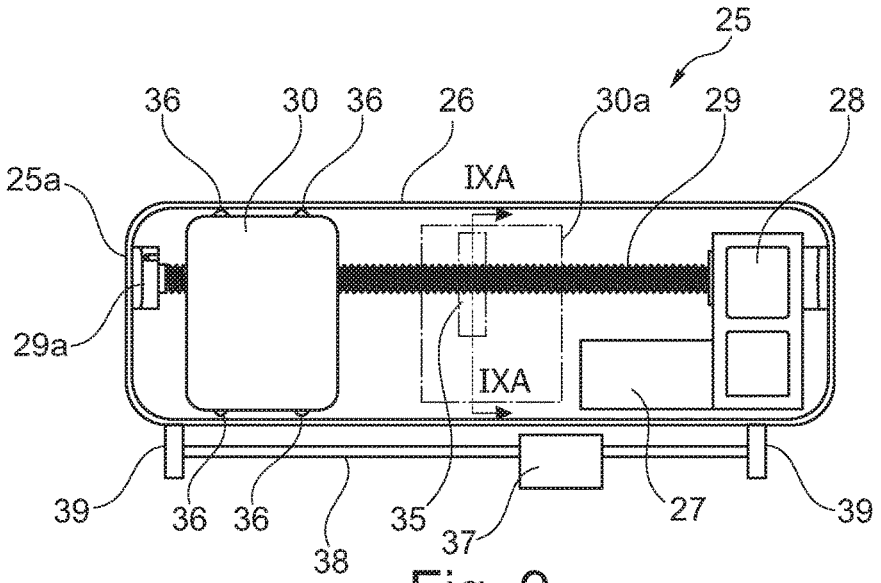

FIG. 9 shows a cross-section view of the weight arm of the weight section.

Figure 9A:
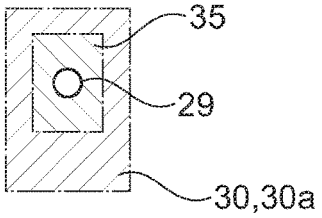

FIG. 9A illustrates a cross-section view of the weight body 30, nut 35 and rod 29 along the line IXA-IXA in FIG. 9.

Figure 10:
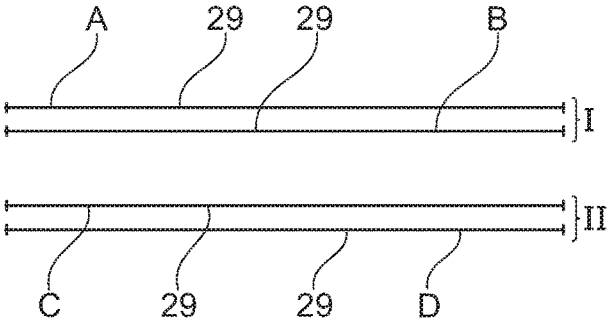

FIG. 10 shows a schematical view of the function of the training machine according to the invention.

Figure 2:
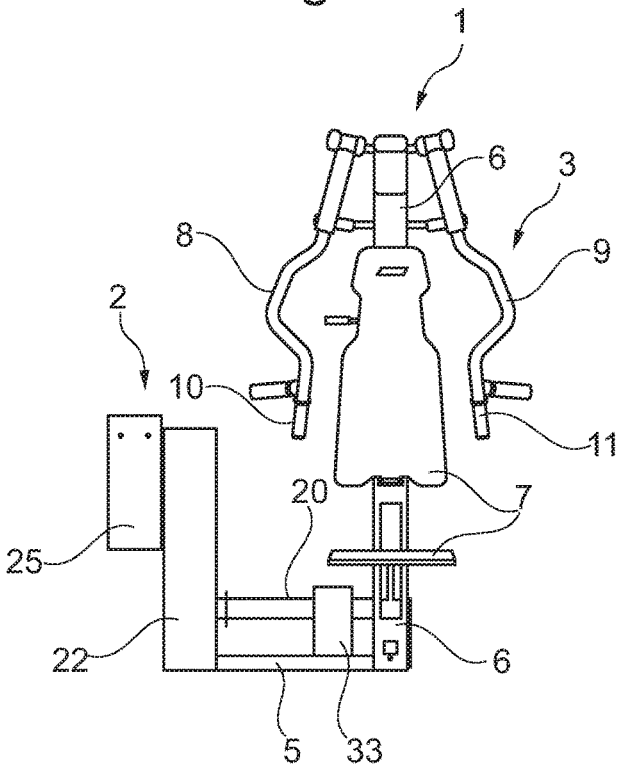
FIG. 2 shows a front view of the training machine of FIG. 1.
Figure 3:
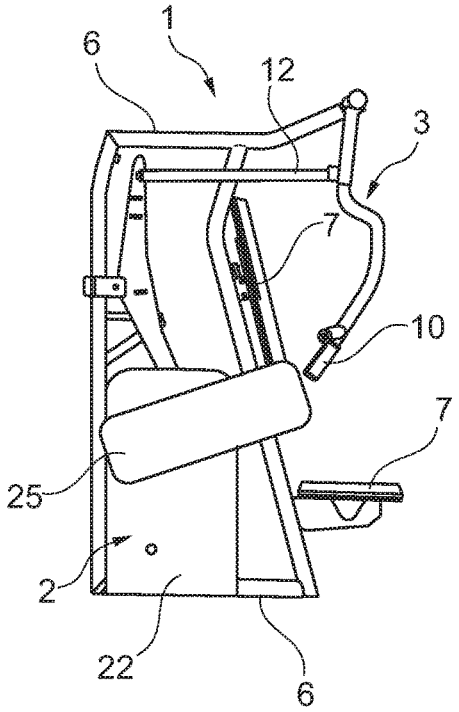
FIG. 3 shows a side view of the training machine from the opposite side as FIG. 1.
Figure 4:
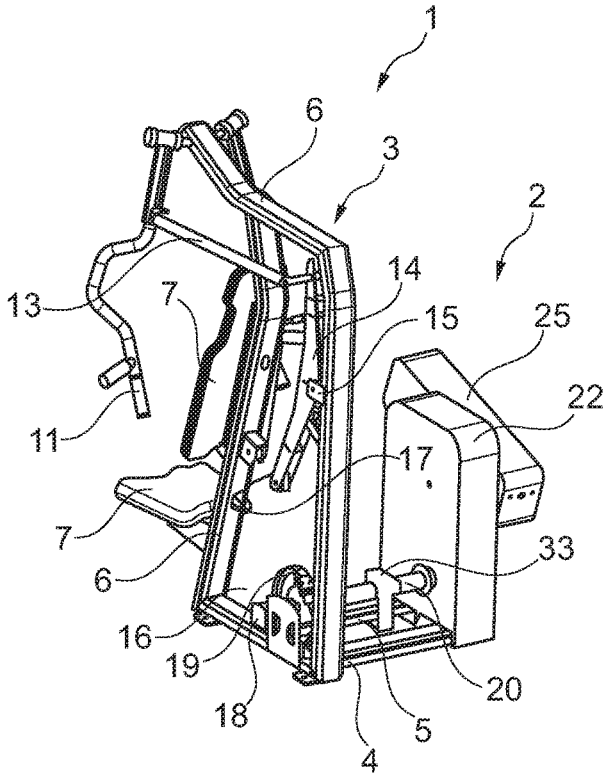
FIG. 4 shows a perspective view of the training machine of FIG. 1.
Figure 5:
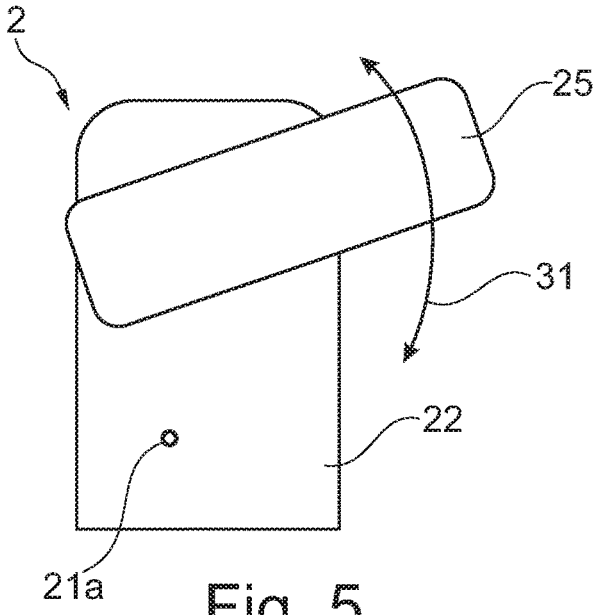
FIG. 5 shows a side view, similar to the one of FIG. 3, of the weight section of the training machine, where the training section of the machine has been deleted for clarity reasons.

In FIGS. 1 to 9, a training machine 1 according to the invention for strength training and rehabilitation is shown, which machine comprises a weight section 2 and a training section 3 (see FIG. 2). The weight section 2 and the training section 3 are fixedly connected to each other by beams 4 and 5. The training section 3 comprises a frame 6, at which the beams 4, 5 are fastened. The opposite ends of the beams 4, 5 are fastened at a housing 22 of the weight section 2. On the frame 6 a seat 7 for the user of the machine is provided. Two bent rods 8 and 9 are journalled in bearings at the top of the frame 6 and are provided with handles 10, 11 for the user at the lower, opposite ends. Ends of link arms 12, 13 are journalled in bearings at the rods 8, 9 at a distance from said top of the frame 6. The other ends of the link arms 12, 13 are journalled in bearings at an upper end of a beam 14. The beam 14 is journalled in bearings at the middle thereof at 15 at the frame 6, and its opposite end is connected to a first Kevlar® belt 16. The first Kevlar® belt 16 extends via rollers 17 and 18 to a first wheel 19. The first wheel 19 is connected to a shaft 20 which has an opposite end which is connected to a second wheel 21 inside the housing 22 of the weight section 2 (see FIG. 8). A second Kevlar® belt 23 is connected between the second wheel 21 and a third wheel 24 inside the housing 22. Both wheels 21 and 24 are journalled in bearings at 21*a* and 24*a* in the housing 22 of the weight section 2.

The third wheel 24 is fixed to one end portion of an arm 25, having a housing 26. Inside the housing 26 it is provided a weight body shifting mechanism comprising a reversible motor or driving means 27, a gear box 28, a threaded rod 29 and a weight body 30 which can be supported by wheels 36 or the like. The motor 27 will be actuated to turn the threaded rod 29 in either direction via the gear in the gear box 28. The threaded rod is journalled in a bearing 29*a* at the outer free end 25*a* of the arm 25. The weight body 30 which inside is provided with a fixed, threaded nut 35 will then move the weight body 30 in both directions along the threaded rod 29. When the user performs the positive and negative movements the arm 25 is moved in either direction automatically by means of a pulse generator or the like which senses that the movement is going to change to the other direction, which is shown by means of a double arrow 31. The weight body 30 which is provided at or in the arm is accordingly arranged to move automatically by means of said reversible motor or driving means 27 along the arm and shift said weight body 30 to predetermined positions depending on the positive or the negative movement. When the user presses the handles 10, 11 away from his/her body to perform a positive movement, the third wheel 24 will rotate in the direction of an arrow 32 and the weight body 30 is positioned at a position 30*a* shown with broken lines. When the users arms have been stretched out to an outer position, the user has stopped his/her arms and this is registered by a device like a pulse generator 33 or the like which senses the speed of rotation of the shaft 20 in both directions of rotation. The pulse generator 33 or the like also registers the turns, i.e. where the weight body 30 shall change direction of movement. This is performed when the user causes the arm to stop or move a short distance, up to about one millimeter. The weight body 30 is then moved quickly by turning the threaded rod 29 by means of the motor 27 and the gear box 28 to a position further out on the arm 25 towards its free end 25*a*. This will result in that the user will get an increased load/weight during the negative movement. The increase will be in the order of 10 to 100%, preferably 20 to 70%, of the load lifted during the positive movement. The load is calculated as the torque force in Nm executed on the centre axis of the wheel 24. After lifting the load during the positive movement, the user performs the negative movement with an increased load by moving the handles 10, 11 in a return path towards his/her body and the wheel 24 will accordingly rotate in the opposite direction as is indicated by an arrow 34. When the handles 10, 11 reaches the turning position, the pulse generator 33 or the like again actuates the motor 27 to move the weight body 30 back to the position 30*a* and the user can start a positive movement again and vice versa. The pulse generator 33 or the like is able to feel the end of the positive movement as well as the negative movement, i.e. when the user stops to move the handles 10, 11 after one of these movements. It should be noted, that the angle of the arm in respect of a horizontal plane concerning the start position as well as the end position can be varied. The position of the weight body 30 on the threaded rod 29 can also be varied. The movement of the weight body 30 towards the free end of the arm 25 at the negative movement depends on how much additional load has to be used during the negative movement. This will be explained more in detail with reference to FIG. 10.

To increase the load an additional weight body 37, could be mounted on an additional rod 38 parallel to the threaded rod 29, wherein the position of the additional weight body on the additional rod could be changed manually. The additional rod is also mounted on the arm 25 by means of consoles 39. In another embodiment, not shown, the arm 25 comprises an arm with two threaded rods which could be programmed to execute special load changes on the arm. In yet another embodiment the arm could be journalled in bearings towards the middle of the arm or at a distance from the arm, so that the arm penetrates out from both sides of the housing. This could be advantageous to exert different loads at different movements of the arm. At such an embodiment the arm could be provided with two threaded rods independently rotatable, each provided with a weight which can be of equal or different weight.

The load of the weight body 30 exerted on the handles 10, 11 depends, on one hand, on the weight of the weight body 30, i.e. the weight in kilos, and, on the other hand, the position of the weight body 30 along the threaded rod 29. The increase of load that the weight body exerts on the handles during the shift from the positive to the negative movements depends on the movement of and positioning the weight body 29 along the threaded rod 29 from the position of the positive movement to the position of the negative movement further out on the arm 25.

The tiltable arm 25 of the training machine is via links 9, 13, 14, 20, wheels 19, 21, 24 and belts 16, 23 connected to the handles 10, 11 and the weight body 30 provided at the arm 25 is accordingly arranged to move along the arm to predetermined positions depending on the load which is intended to be exerted on the handles.

In FIG. 10 a schematical view of two examples concerning different kind of users is shown. In view I, a stronger person sets the machine so that the weight is placed at a position A during the negative movement and at a position B during the positive movement by rotating the threaded rod 29 in either direction. In view II, a weaker person sets the machine so that the weight is placed at a position C during the negative movement and at a position D during the positive movement by rotating the threaded rod 29 in either direction. These positions are only by way of example, which means that any other position along the threaded rod 29 could be set, provided that the position A is further out on the threaded rod 29 than the position B, and that the position C is further out on the threaded rod 29 than the position D.

At the embodiment shown of the training machine according to the invention, described above, it is achieved that the training person may lower a heavier weight load during the positive movement than could be possible with a normal, previously known machine.

It is obvious that the training machine according to the invention can be modified so that it can be used for different types of training machines such as training with both single-joint movements, such as by a biceps curl machine or a leg kick machine, and with multiple-joint movements, such as by a rowing machine, a bench press machine or a leg press machine. In different types of machines, the handles are used as press or pull handles.

In the preferred embodiment the movement of the weight body is provided by means of a threaded rod and nut device. It is within the scope of the claims that this movement can be performed by any known transfer means (also referred to as transmission means), such as a chain transmission, a belt transmission or the like.

The training machine according to the invention may be modified within the scope of the appended claims.

The invention claimed is:

1. A training machine for strength training and rehabilitation comprising:

a frame;

pull or press means mounted to the frame and being constructed and arranged to be moved in a first positive direction and a second opposing negative direction by a user;

a tiltable arm connected to the pull or press means and being rotatably mounted to the frame by a rotatable mount, wherein when the pull or press means is moved between the first and second directions the tiltable arm is rotated between a first arm position having a first angle from a horizontal plane and a second arm position having a second angle from the horizontal plane;

a pulse generator in communication with the pull or press means, the pulse generator constructed to register a first change or shift in direction from the first positive direction to the second opposing negative direction and register a second change or shift in direction from the second opposing negative direction to the first positive direction;

the tiltable arm comprising a weight body being movably mounted on or within the tiltable arm so that the weight body can be moved along a length of the tiltable arm from a first weight body position a first distance from the rotatable mount and a second weight body position a second distance from the rotatable mount, the second distance being greater than the first distance; and the tiltable arm comprising driving means constructed to move the weight body along the length of the tiltable arm, wherein the driving means automatically moves the weight body to the second weight body position when the pulse generator registers the first change or shift and automatically moves the weight body to the first weight body position when the pulse generator registers the second change or shift so that a first load on the pull or press means during movement of the pull or press means in the first positive direction is less than a second load on the pull or press means during movement of the pull or press means in the second negative direction by the user.

2. The training machine according to claim 1, wherein the weight body is within the tiltable arm.

3. The training machine according to claim 2, wherein the driving means is within the tiltable arm.

4. The training machine according to claim 1, wherein said weight body is moved along said arm by means of said driving means and transmission means.

5. The training machine according to claim 1, wherein said arm is provided outside a housing containing a wheel and belt transmission and in that said arm is fixed to said wheel.

6. The training machine according to claim 1, wherein said driving means is an electric motor or a hydraulic piston and cylinder device.

7. The training machine according to claim 1, wherein the increase in load from the positive to the negative movement is 10 to 100%.

8. The training machine according to claim 1, wherein the increase in load from the positive to the negative movement is 20 to 70%.

9. The training machine according to claim 1, wherein the driving means comprises a reversible motor connected to the weight body by a gear box, a threaded rod, and fixed nut such that when the motor is activated the motor drives the rotating rod via the gear box and the fixed nut moves along the rotating rod to thereby move the weight body along the length of the tiltable arm.

10. The training machine according to claim 1, wherein the driving means comprises a hydraulic piston.

11. A method of strength training and rehabilitation comprising:

providing a training machine according to claim 1;

moving the pull or press means in the first positive direction by the user until a first change or shift in direction from the first positive direction to the second opposing negative direction is registered by the pulse generator and the drive means is automatically activated to move to the weight body to the second weight body position; and moving the pull or press means in the second negative direction by the user until a second change or shift in direction from the second opposing negative direction to the first positive direction is registered by the pulse generator and the drive means is automatically activated to move the weight body to the first weight body position.

12. The training machine according to claim 1, wherein the pull or press means comprises handles.

* * * * *